US006978910B2

(12) United States Patent
Sanders et al.

(10) Patent No.: US 6,978,910 B2
(45) Date of Patent: Dec. 27, 2005

(54) ANTI-SPILL DEVICE FOR CUP AND LID

(75) Inventors: Robert T. Sanders, Canby, OR (US); Craig R. Anderson, Canby, OR (US)

(73) Assignee: Sanson, LLC, Canby, OR (US)

( * ) Notice: Subject to any disclaimer, the term of this patent is extended or adjusted under 35 U.S.C. 154(b) by 138 days.

(21) Appl. No.: 10/672,915

(22) Filed: Sep. 25, 2003

(65) Prior Publication Data

US 2005/0067417 A1 Mar. 31, 2005

(51) Int. Cl.[7] ..... B65D 45/02
(52) U.S. Cl. ..... 220/713; 220/326; 220/714
(58) Field of Search ..... 220/713, 714, 220/711, 254.1, 254.3, 740, 742, 375, 326, 220/324

(56) References Cited

U.S. PATENT DOCUMENTS 2,447,870 A * 8/1948 Polcyn ..... 220/715
3,848,768 A * 11/1974 Griffin ..... 220/724
5,944,238 A * 8/1999 Stark ..... 224/148.4
6,702,145 B2 3/2004 Malcolm

OTHER PUBLICATIONS

TravelerPlus Press Release, "Increase Customer Satisfaction and Enhance Your Operation's Image with Solo Cup Company's Traveler Plus™ Lid," 3pp (2003).

* cited by examiner

*Primary Examiner*—Stephen Castellano
(74) *Attorney, Agent, or Firm*—Klarquist Sparkman, LLP

(57) ABSTRACT

An anti-spill device used in conjunction with a disposable cup and lid combination for preventing spillage through a sip hole in the lid is disclosed. The anti-spill device includes a cup gripping member that forms two arcuate-shaped flexible arms for securing the cup to the device. The device includes at least one retaining latch that is attached to the cup gripping member by a first retaining channel is integrated into the gripping member. The device further includes a horizontally flexing member connected to the gripping member by a second retaining channel that is integrated into the gripping member. Finally, the device includes a flexible sealing member with a lid engaging area which is biased to cover the sip hole in the disposable lid. A user desiring to drink the beverage within the cup gains access to the sip hole by engaging the device to lift and shift the lid engaging area away from the sip hole.

15 Claims, 3 Drawing Sheets

ANTI-SPILL DEVICE FOR CUP AND LID

FIELD

The present invention relates generally to a device for preventing spills in beverage containers and, more specifically, to a device for preventing beverage spills in disposable cups having lids with open sip holes.

BACKGROUND

In today's society, many hot beverages are served in disposable cups with disposable lids for convenient and efficient beverage consumption. The cup contains the beverage while the lid acts as a sealer for ensuring that the beverage stays within the cup, thus preventing excessive spillage of the beverage. The types of cup lids for use with the standardized frusto conical disposable cups are many. Most of these lid designs employ a form of drinking access to the beverage. Many disposable lid designs include a small quasi-oval shaped sip hole to facilitate the drinking of a beverage without removing the lid, thereby maintaining the seal between the cup and lid.

Despite the seal between the cup and lid and the relative small size of sip holes, spills and leaks often occur as a result of the beverage sloshing and spilling out the sip hole. In a worst case scenario with a full cup, a hot or cold beverage may spill out of the sip hole in geyser-like fashion, possibly staining the user's clothing or automobile interior or burning the user.

One attempt to address this problem is the Traveler Plus™ lid made by Solo. The Traveler Plus™ lid provides a user-initiated, separately attached sip hole cover under the lid to close the sip hole when the user is not drinking the beverage. The cover includes a latch that extends through a slot in the lid and, when pushed or pulled by a finger of the user, the cover swivels away from or towards the sip hole to open and close the sip hole.

Despite some apparent advantages, the Traveler Plus™ lid retains several drawbacks. First, the location of the latch is such that a user may have difficulty holding the cup and accessing the latch with one hand. As a practical matter, most users will find it necessary to hold the cup in one hand and open or close the latch with the other hand. Because beverage drinkers often desire to drink beverages contained in the disposable cup while driving or holding another item in one hand, a user cannot drink through the lid without dangerously or inconveniently using both hands. Therefore, a need exists for preventing spillage of beverages through a sip hole in disposable lids while holding the cup with a single hand.

Second, the Traveler Plus™ lid has a two-piece construction, making the lid relatively complicated and costly to manufacture. Manufacturers of disposable lids generally produce and sell lids in bulk. Therefore, even a small increase in manufacturing costs per lid results in a significant increase in cost which is generally passed to retailers, i.e. coffee houses, restaurants, gas stations, etc., that purchase in bulk. A more costly lid may cause some retailers to use a more conventional, less costly disposable lid.

Furthermore, lids with complicated and complex lid designs, such as the Travel Plus™ lid, are more difficult to nest and thus more expensive to distribute on a commercial scale. Because of the potential fallbacks of using a more complex disposable lid, many beverage retailers continue to use stackable lids with an uncovered sip hole. Therefore, a need exists to prevent beverage spills in disposable cup and lid combinations which allow beverage retailers to retain the economical incentives associated with the use of more conventional disposable lid designs.

The instant invention satisfies this need through a reusable, easily attachable, anti-spill device, which when used in conjunction with a conventional cup and lid combination, prevents the spillage of a beverage through the lid's sip hole when not in use. Specifically, beverage retailers may continue to provide beverages in a conventional cup and lid combination while beverage consumers can make use of the present invention to prevent spills when handling those beverage cup and lid combinations "on the run."

SUMMARY

The present invention provides, in one representative embodiment, an anti-spill device for preventing spillage through a sip hole in a cup and lid combination due to the sloshing and movement of a beverage during the jostling associated with drinking, handling and traveling with the beverage.

In one embodiment, the anti-spill device includes a cup gripping member that forms two arcuate-shaped flexible arms for securing the cup. At least one locking latch preferably is attached to the gripping member by retaining channels integrated into the gripping member. When the device is attached to the cup and lid combination, the latch or latches preferably apply a downward force on the lid thus securing the device against the lid and cup rim and preventing the device from sliding down the cup.

In a preferred embodiment, a horizontally flexing member is connected to the gripping member by a retaining channel integrated into the gripping member. The horizontally flexing member is formed in an "S" shape to create a spring bias in the horizontal direction.

Finally, a flexible sealing member with a lid engaging portion at one end preferably is formed to the horizontally flexing member at its other end. The flexible sealing member extends vertically up one side of the lid, bends and traverses the diameter of the lid. A bias spring, molded into the structure of the sealing member, biases the lid engaging portion to a position below the top of the cup lid so that pressure from the lid engaging portion will be applied to a sip hole formed in the lid, thus sealing the sip hole.

A user desiring to drink the beverage may then, using a finger of the hand securing the cup, apply pressure to a sealing member actuator located on the flexible sealing member to vertically rise and horizontally shift the lid engaging portion to uncover the sip hole to access to the beverage.

DETAILED DESCRIPTION OF A PREFERRED EMBODIMENT

Figure 1:
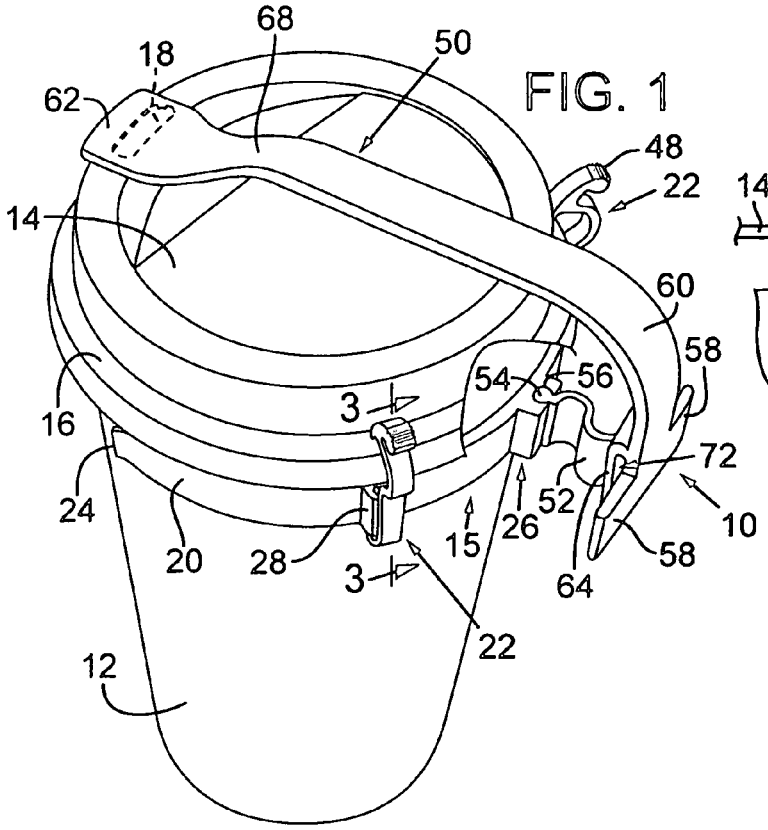
FIG. 1 is a perspective view of an anti-spill device as attached to a conventional cup and lid combination according to one embodiment of the present invention.

FIG. 1 is a perspective view of an anti-spill device 10 as attached to a conventional cup 12 and lid 14 combination according to one preferred embodiment of the present invention. The cup 12 has a conventional frusto conical shape and includes a mouth (not shown) and an upper lip 30 (FIG. 3) circumscribing the mouth of the cup. A rim 16 of the lid 14 includes a recess for facilitating the removable attachment of the lid 14 to the lip 30 of the cup. The lid 14 snaps in place against the lip 30, with the rim 16 bearing against the lip 30 to form a liquid tight seal. The lid 14 further includes a sip hole 18 (FIG. 2) for allowing a user to drink the beverage contained in the cup 12 without removing the lid.

Figure 2:
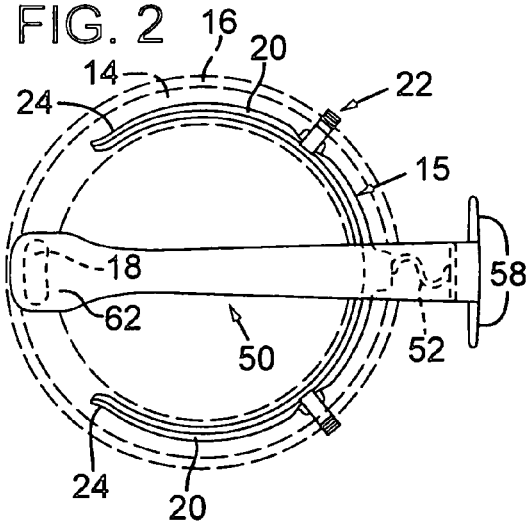
FIG. 2 is a top plane view of the anti-spill device of FIG. 1 in its closed position.

The anti-spill device includes a cup gripping member 15 to releasably attach the device to disposable cup/lid combinations of different sizes. The cup gripping member 15 includes a centrally located spring retaining channel 26, a pair of flexible arcuate gripper arms 20 and a pair of lid latches 22. As shown in FIGS. 1 and 2, the cup gripper arms 20 extend in opposite directions circumferentially around cup 12 from the spring retaining channel 26. Each cup gripper arm 20 preferably includes an outwardly flared end portion 24 for ease of sliding the arms 20 around the cup 12. In order to secure the device to the cup 12, the cup gripper arms 20 preferably extend more than half way around the cup at a location just below, if not in contact with, the lip 30. Preferably, the cup gripping member 15 extends about two-thirds to three-fourths around the circumference of the cup. Furthermore, the cup gripper arms 20 are spring biased such that the diameter of the semi-circular arc formed by the gripping arms is less than the diameter of the cup at a location just below the lip 30. To improve the securing of a traditional frusto conical shaped cup, according to one embodiment, an inner surface of the cup gripper arms 20 that is adjacent to the outer surface of the cup is tapered with a top and bottom that define planes essentially parallel to the planes defined by the rim and base of the cup to be used.

The diameter of the arc formed by the gripping arms and spring strength of the gripping arms is selected as a matter of routine to allow the cup gripper arms to expand easily to fit standard cup sizes (such as small, medium, large) and yet apply a secure gripping force to cups of different sizes. According to one embodiment, the diameter of the inner circle formed by the cup gripping member 15 is about 0.100 inches smaller than the smallest standard cup size. It is recognized that as disposable cups may significantly vary in size, adjustment of the dimensions of the cup gripping member 15 may be necessary to ensure a secure attachment to cups that are unusually large or small compared to typical cup sizes.

Figure 3:
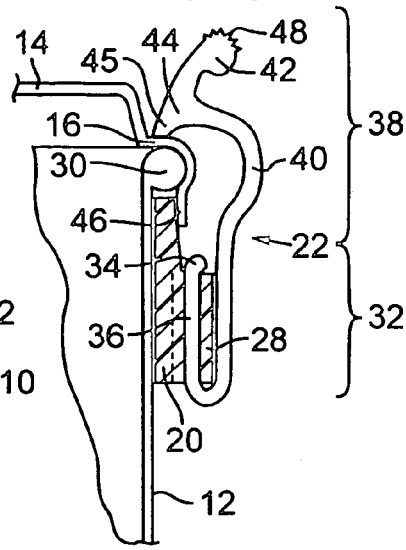
FIG. 3 is a cross-sectional view taken along line 3—3 of FIG. 1.

The lid latches 22, as shown in FIG. 1 and in more detail in FIG. 3, are coupled to the cup gripping member 15 by lid latch retaining channels 28 that preferably are molded into the cup gripper arms 20. Lid latch retaining channels 28 and latches 22 can be located anywhere on the cup gripper arms 20. However, in one preferred embodiment, two latch retaining channels 28 and corresponding latches 22 are located on opposite cup gripper arms 20 and positioned toward the back of the anti-spill device at an equal distance away from retaining channel 26 (FIG. 2).

The latch 22 includes a U-shaped lower portion 32 having an inner leg 36 terminating at a lip 34. Leg 36 is seated within a slot formed in the latch retaining channel 28. The U-shaped lower portion 32 is formed to create a slight inward bias. The bias causes the lip 34 to contact an upper outward surface of the retaining channel 28, thereby securing the latch 22 within the retaining channel 28 and providing a secure attachment of the latch 22 to the cup gripping member 15.

The latch also includes an upper portion 38 having an arched portion 40, lid latch release lever 42 and a lid contact portion 44. The arched portion 40 is dimensioned to provide clearance space for lid rim 16 and lid skirt 46 when lid 14 is attached to cup 12. The latch release lever 42 serves to facilitate the manual attachment of the anti-spill device to the lid 14 and detachment of the anti-spill device from the lid 14. The lever 42 is pressed by the user to lock latch 22 against lid rim 16 during attachment of anti-spill device. The lever 42 also may be pulled by the user to disengage the latch 22 against the lid rim 16 during detachment of the anti-spill device from cup 12 and lid 14, allowing the lid to be separated from the cup. Further, in one preferred embodiment, the latch release lever 42 includes a ribbed surface 48 to promote the gripability of the latch 22 by a finger of the anti-spill device user. The lid contact portion 44 includes a downward projected tip 45 which contacts lid rim 16 and provides a downward force which secures latch 22 against rim 16.

With gripper arms 20 in place against the bottom of the cup rim 30 and latch 22 is engaged against the lid rim 16, the cup gripping member 15 is prevented from sliding down the cup 12. Latch 22 preferably is formed of a springy plastic material such that the latch 22 has sufficient flex to fit a range of cup lid thicknesses.

Referring back to FIG. 1, according to one embodiment, the anti-spill device of the present invention includes a horizontally flexing member 52 integrated into the flexible sealing member 50. Flexing member 52 has a male attachment member 54 to facilitate its attachment to the cup gripping member 15. Male portion 54 is removably received within a corresponding female slot 56 formed in the retaining channel 26. Male portion 54 and slot 56 are tapered at their lower ends to allow the male portion to be easily inserted into and wedged downwardly within the retaining channel. According to one embodiment, the member 52 may be formed in an S-shaped manner to reduce the risk of permanent memory set caused by extensive flexing of member 52 over time. Flexing member 52 is generally formed of a flexible material of sufficient length and strength to provide durability against fatigue and failure.

Figure 5:
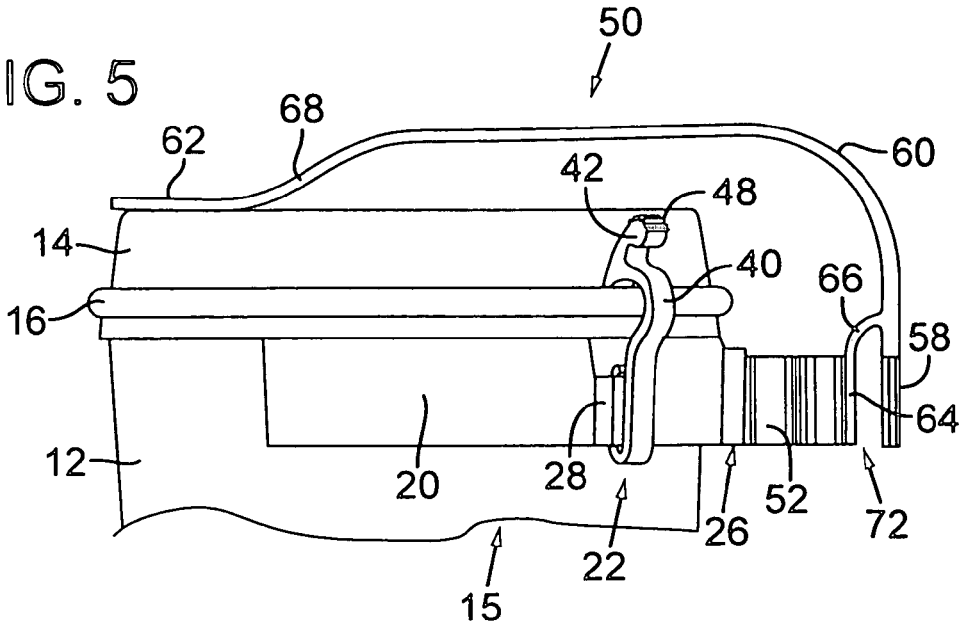
FIG. 5 is a side elevation view of the anti-spill device of FIG. 1 and the lid to which the device is attached.
Figure 6:
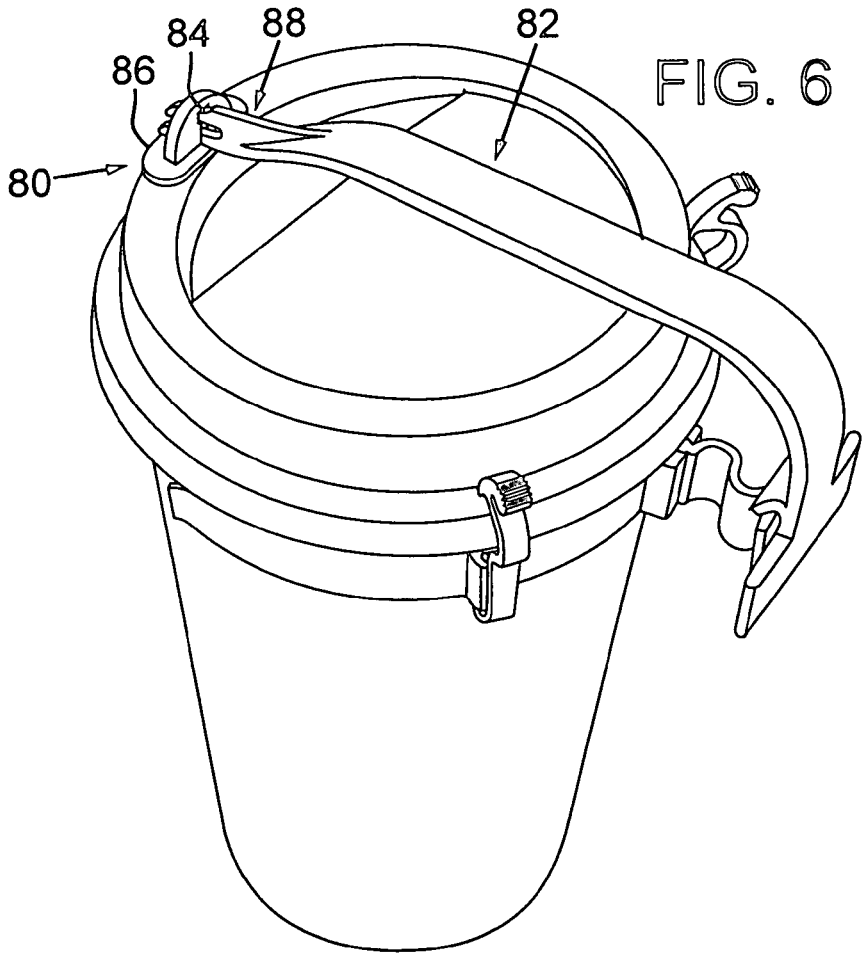
FIG. 6 is a perspective view of an anti-spill device with a modified flexible sealing member according to another embodiment of the present invention.
Figure 7:
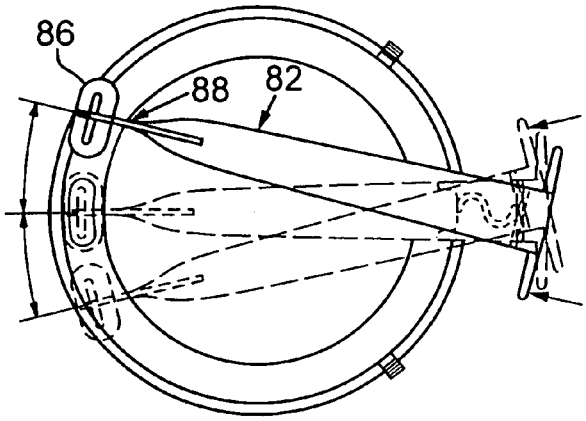
FIG. 7 is a top plane view of the anti-spill device of FIG. 6 in its open position.

The flexible sealing member 50 includes an integrated vertical lift flexible member 72, integrated finger operated sealing member actuator 58, bias member 60, lid cam 68 and lid engaging portion 62 which preferably are molded together to form a single, unitary member. Integrated vertical lift flexible member 72 (FIGS. 1 & 5) includes a lower flat portion 64 that is vertically positioned so as to be substantially parallel to actuator 58. The vertical lift flexible member 72 further includes an upper portion 66 forming an arcuate shape. Flexing member 52 is connected to the flat portion 64, while upper portion 66 is an integral molded extension of actuator 58. The actuator 58 forms a flat panel with sides extending beyond a width of the vertical lift flexible member 72 to provide leverage and a contact area for the user's finger.

Bias member 60 includes a first portion extending in a substantially vertical direction, a second portion forming an arch and a third portion extending in a direction nearly perpendicular to the first portion. The first portion extends in a vertical direction sufficient to allow the third portion to clear the top surface of the lid. The arch angle of the second portion preferably is equal to or slightly less than 90 degrees to give the third portion a downward cant.

The flexible sealing member 50 further including a lid cam 68 which forms a slope and connects the third portion to lid engaging portion 62. The lid engaging portion 62 forming a substantially flat, rectangular-shaped cover. The anti-spill device is orientated by the user so that lid engaging portion 62 covers sip hole 18 of lid 14. The lid engaging portion 62, being indirectly connected to the bias member 60, is biased such that at least a tip of the lid engaging portion 62 is urged to a position below the surface of the lid 14 that contains the sip hole 18. The lid engaging portion 62 is positioned to ensure that the lid engaging portion 62 will apply a constant sealing pressure to the sip hole 18 when user is not engaging the anti-spill device. The lid engaging portion 62 is made of a sufficiently flexible material so that the lid engaging portion 62 can adapt to any number of lid surfaces. In one embodiment, a malleable material can be adhered to a lower surface of lid engaging portion 62 to enhance the sealing capabilities of the anti-spill device.

Figure 4:
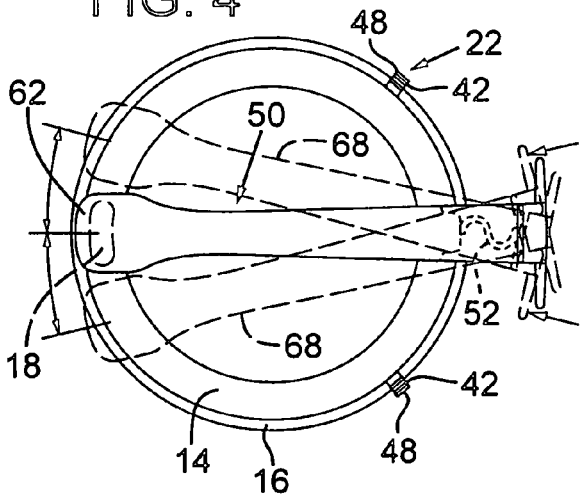
FIG. 4 is a top plane view of the anti-spill device and cup and lid combination of FIG. 1 in its open position.

With the anti-spill device 10 positioned such that lid engaging portion 62 covers sip hole 18, the beverage is prevented from exiting through sip hole 18. As illustrated in FIG. 4, a user now desiring to use sip hole 18 for drinking the contained beverage need only apply finger pressure (see arrow) to actuator 58. The finger pressure causes lid engaging portion 62 to lift upwardly away from and to one side of the sip hole. By so applying finger pressure, the user with one hand can hold the cup, unseal the sip hole and drink the beverage. Afterwards, the user releases the actuator 58, thereby allowing the lid engaging portion 62 to return to its original position covering the sip hole.

Generally, the anti-spill device of the present invention can be made of a plastic material formed through an injection molding or extrusion manufacturing process. Preferably, the cup gripping member 15, latches 22 and flexible sealing member 50 are each formed separately and assembled together following manufacturing. However, it is recognized that the above elements of the anti-spill device can be formed together simultaneously, thereby foregoing post-manufacture assembly.

In another illustrated embodiment, as shown in FIGS. 6–10, an articulated lid engaging portion 80 is pivotably attached to a modified flexible sealing member 82. The articulated lid engaging portion 80 includes a flexible sealing member slot 84 and a sip opening sealing portion 86.

Figure 9:
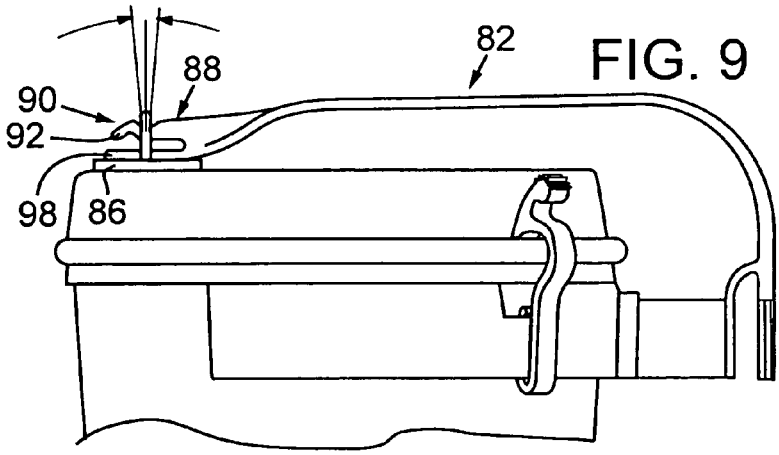
FIG. 9 is a side elevation view of the anti-spill device of FIG. 6.
Figure 10:
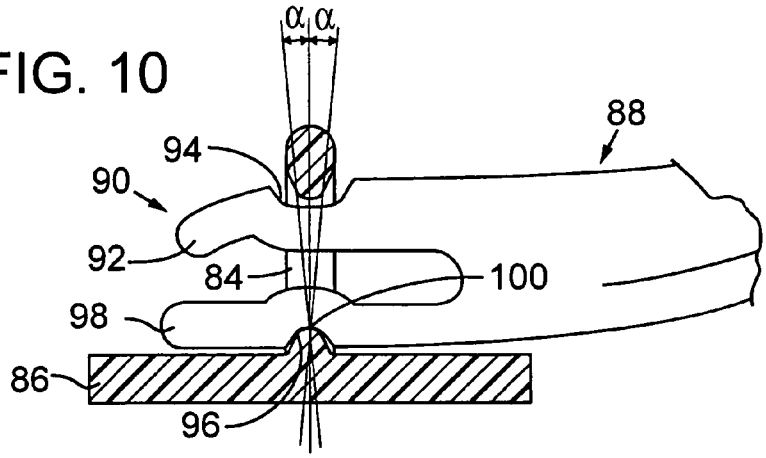
FIG. 10 is an enlarged, partially sectional view of a portion of the embodiment of FIG. 6.

As illustrated in FIGS. 9 and 10, the modified flexible sealing member 82 includes flexible attachment prongs 88. The attachment prongs 88 include a top retaining prong 90 and a bottom pivot prong 98. The top retaining prong 90 includes a cantilevered angled tip 92 and recess 94 to facilitate snap-fit attachment of the sealing portion 86 to the top prong. The lower pivot prong 98 includes a recess 96 which serves as a pivot point for the sealing portion 86.

Figure 8:
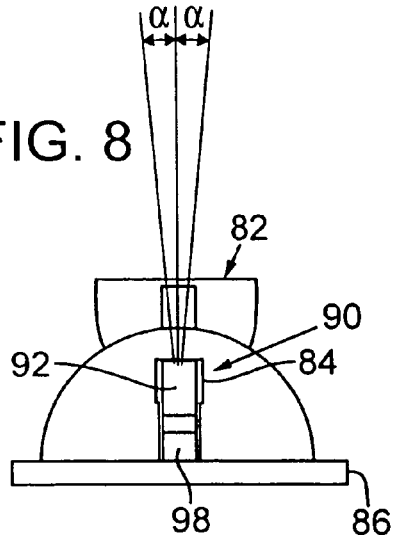
FIG. 8 is a frontal elevation view of the modified sealing member and lid engaging portion of FIG. 6.

The sealing portion 86 is pivotably attached to the flexible sealing member 82 by inwardly flexing the flexible attachment prongs 92, 98 and inserting the prongs into slot 84 (FIG. 8). The prongs are inserted until recesses 94, 96 align with slot 84, allowing the prongs to snap into place. The upper recess 94 is dimensioned to provide clearance for movement of the articulated lid-engaging portion when pivoting around a pivot point 100 located where a lower surface of the slot contacts an innermost portion of recess 96. In this embodiment, the lid-engaging portion 80 may freely rotate up to angle $\alpha$ in any direction, as shown in FIG. 10. In one embodiment, the upper recess 94 allows the articulated lid-engaging portion to preferably rotate up to about five degrees around pivot point 100. The pivotal range of motion allows the lid-engaging portion 80 to conform to or compensate for uneven lid surfaces.

The anti-spill device is durable, microwavable and reusable with one disposable cup/lid after another. The device may be used with most existing disposable cup/lid designs, without requiring fast food restaurants, coffee shops, beverage stands or other dispensers of "to go" beverages to purchase expensive, disposable lid designs having built in sip-hole sealing mechanisms.

The terms and expressions which have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A spill reducing apparatus suitable for releasable attachment to a cup and lid combination, comprising:

a cup gripping member for gripping the cup, the cup gripping member comprising a substantially arcuate flexible member;

at least one locking latch coupled to the cup gripping member, the latch being configured to apply a releasable downward force on the lid; and a flexible sealing member coupled to the gripping member;

the sealing member having a substantially horizontal portion which extends over the lid and terminates at a lid opening sealing portion.

2. The apparatus of claim 1 wherein the apparatus is made of plastic material.

3. The apparatus of claim 1 wherein the sealing member is spring biased downwardly to engage the lid, the apparatus including a sealing member actuator connected to the sealing member to permit the sealing member to be moved sideways relative to the lid.

4. The apparatus of claim 3 wherein the sealing member has a substantially vertical portion and is configured to have a downward spring bias when the apparatus is attached to the cup and lid combination.

5. The apparatus of claim 3 wherein the actuator is configured to accept pressure from a left or right finger, the pressure causing the sealing member to lift upwardly and outwardly away from an opening in the lid.

6. The apparatus of claim 3 wherein the cup gripping member and lid engaging portion are configured to cover lid openings of lids having different sizes.

7. The apparatus of claim 6 wherein the cup gripping member comprises attachment prongs and the lid engaging portion comprises a receiving slot for receiving the attachment prongs, the cup gripping member being configured to allow the lid engaging portion to pivotably rotate.

8. The apparatus of claim 1 wherein the sealing member comprises a substantially "S" shaped horizontally flexible member.

9. The apparatus of claim 1 wherein the gripping member has an opening to receive the cup and flexible gripping arms capable of moving away from one another to enlarge the opening.

10. The apparatus of claim 9 wherein the gripping member has an inner diameter less than a standard small size cup, and the gripping arms are sufficiently flexible to fit standard large size cups.

11. The apparatus of claim 10 wherein the gripping arms are long enough to extend at least half way around the circumference of the cup.

12. The apparatus of claim 9 wherein the gripping arms terminate at outwardly flared ends.

13. The apparatus of claim 1 wherein each locking latch is of a unitary, one piece construction releasably attached to the gripping member.

14. The apparatus of claim 13 wherein each locking latch has a substantially downwardly directed tip portion capable of providing a downward force against a lip portion of the lid.

15. The apparatus of claim 1 wherein the cup gripping member includes at least one retaining channel to receive each latch.

* * * * *